US006953511B2

(12) United States Patent
Bowles, Jr. et al.

(10) Patent No.: US 6,953,511 B2
(45) Date of Patent: Oct. 11, 2005

(54) METHOD FOR HIGH DEFINITION DIP TRANSFER PRINTING AND ARTICLE MADE ACCORDING TO METHOD

(75) Inventors: Royce J. Bowles, Jr., Fortson, GA (US); James Patrick Epling, Downingtown, PA (US); James Phillip Hand, Columbus, GA (US); Samuel C. Ruffner, Columbus, GA (US); Jeffery Wayne Walker, Columbus, GA (US)

(73) Assignee: Immersion Graphics Corporation, Columbus, GA (US)

( * ) Notice: Subject to any disclaimer, the term of this patent is extended or adjusted under 35 U.S.C. 154(b) by 211 days.

(21) Appl. No.: 09/901,210

(22) Filed: Jul. 9, 2001

(65) Prior Publication Data

US 2003/0007053 A1 Jan. 9, 2003

(51) Int. Cl.[7] ..... B44C 1/175; B41M 3/12; B41M 1/14; B05D 1/38; B05D 1/20

(52) U.S. Cl. ..... 156/230; 156/236; 156/240; 156/277; 427/146; 427/149; 427/262; 427/434.3; 118/402; 101/34; 101/171; 101/211; 101/481

(58) Field of Search ..... 156/230, 236, 156/239, 240, 241, 247, 277, 289, 384, 350, 378, 244.27; 427/146, 149, 434.2, 262, 147, 144, 256, 258, 264, 267, 271, 272, 430.1; 101/33, 34, 481, 171, 211; 118/402, 403

(56) References Cited

U.S. PATENT DOCUMENTS

| | | | | | |
|---|---|---|---|---|---|
| 2,489,987 | A | | 11/1949 | Barnola | 154/98 |
| 2,981,632 | A | | 4/1961 | Bennett | 117/39 |
| 4,231,829 | A | * | 11/1980 | Marui et al. | 156/230 |
| 4,269,650 | A | | 5/1981 | Arai et al. | 156/540 |
| 4,378,387 | A | | 3/1983 | Mitchell | 427/263 |
| 4,436,571 | A | * | 3/1984 | Nakanishi | 156/384 |
| 5,695,587 | A | * | 12/1997 | Dumoux | 156/230 |
| 5,727,253 | A | | 3/1998 | Wilkinson | 2/69 |
| 5,908,525 | A | | 6/1999 | Zaher | 156/230 |
| 5,916,400 | A | | 6/1999 | Zaher | 156/230 |
| 5,924,131 | A | | 7/1999 | Wilkinson | 2/69 |
| 6,001,206 | A | | 12/1999 | Zaher | 156/230 |
| 6,044,764 | A | | 4/2000 | Ogisu | 101/492 |
| 6,070,636 | A | | 6/2000 | Zaher | 156/540 |
| 6,103,043 | A | | 8/2000 | Lin | 156/237 |

FOREIGN PATENT DOCUMENTS

| | | | | |
|---|---|---|---|---|
| EP | 0 918 078 A1 | * | 5/1999 | C09D/11/00 |
| JP | 56082256 A2 | | 7/1981 | |
| JP | 61130081 A | | 6/1986 | |
| JP | 03-063199 | * | 3/1991 | B44C/1/175 |
| JP | 11180098 A2 | | 7/1999 | |

* cited by examiner

*Primary Examiner*—J. A. Lorengo
(74) *Attorney, Agent, or Firm*—Peter G. Pappas, Esq; Sutherland Asbill & Brennan LLP

(57) ABSTRACT

Method for high definition printing to be dip transferred to a three-dimensional article comprises four color process printing a digital image from a digital image file onto a water soluble polymer film with solvent based ink to form a printed water soluble film and dip transfer printing the solvent based ink image through transcription on the surface of the article. The method is suitable for printing three-dimensional articles of a variety of shapes with high definition, photographic-quality images. The method is particularly suitable for decorating articles with complex images such as camouflage patterns.

13 Claims, No Drawings

METHOD FOR HIGH DEFINITION DIP TRANSFER PRINTING AND ARTICLE MADE ACCORDING TO METHOD

TECHNICAL FIELD

This invention generally relates to dip transfer printing, and more particularly, relates to high definition dip transfer printing.

BACKGROUND OF THE INVENTION

Dip transfer printing is useful for applying decoration to three-dimensional articles as distinguished from flat surface printing with paper or film. Dip transfer printing includes printing an image with solvent based ink on a water soluble polymer film, floating the printed water soluble film on water to dissolve the water soluble film, liquefying the solvent based ink image floating on the water with a solvent activator and submerging an article in the water against the liquefied solvent based ink image to transfer the liquefied solvent based image to the surface of the article. Up to this point, images printed using dip transfer printing have been printed on water soluble polymer film using match color printing, which is the same method used to print fabric and wallpaper. In match color printing, each color needed for design is printed as a separate color to complete the desired image. For example, different tones of the same color are printed separately to complete the image. One color of green is printed for light green, another color of green is printed for dark green and different shades of browns and grays are printed separately to produce wood tones.

Match color printing does not accurately reproduce photographic images or other images in which a high definition or high clarity are desired. Accordingly, there is a need for a method of printing high definition photographic-like images on three-dimensional articles such as with dip transfer printing.

SUMMARY OF THE INVENTION

This invention satisfies the above described need by providing a method for high definition printing on an article using dip transfer printing wherein an image is printed from a digital image file onto a water soluble polymer film with solvent based ink to form a printed water soluble film using four color processing printing. Desirably, the digital image file is suitable for printing a seamless repeating pattern. This method is capable of decorating a three-dimensional article with a high definition image such as a photographic image. For example, this method is particularly suitable for printing three-dimensional articles with a high definition camouflage pattern. The digital image file therefore can be a camouflage pattern. It should be understood, however, that this method can be used to apply any image to an article.

More particularly, the method of this invention comprises providing a digital image file, four color process printing an image from the digital image file onto a water soluble polymer film with solvent based ink to form a printed water soluble film, placing the printed water soluble polymer film on water to at least partially dissolve the water soluble film, liquefying the water soluble base ink image floating on the water with a solvent activator, and submerging the article in the water against the liquefied solvent based ink image to transfer the liquefied solvent based ink image to a surface of the article. For example, the digital image file can be formed by taking a digitized image or digital photograph depicting a plurality of digital image elements and arranging the plurality of digital image elements with a computer to form an image suitable for printing a seamless pattern. Again, this method is particularly suitable for printing a three-dimensional article with a complex image such as a camouflage pattern. A camouflage pattern can be created as a digital image file by taking a digitized image or digital photograph depicting vegetation such as tree limbs and the like and arranging digital image elements of the digitized image or digital photograph depicting components of vegetation to form a seamless repeating camouflage pattern.

This invention also encompasses articles made according to the above described method.

Other objects, features, and advantages will become apparent from reading the following detailed description and claims.

DETAILED DESCRIPTION OF THE INVENTION

As summarized above, this invention encompasses a method for decorating articles with a high definition image using dip transfer printing techniques and the resulting decorated articles such as three-dimensional objects. Traditionally, dip transfer printing has been used to decorate three-dimensional articles which could not be printed with other types of printing normally used to print flat flexible materials like paper, film, and other sheet materials. As explained herein above, dip transfer printing includes printing an image onto a water soluble polymer film with solvent based ink to form a printed water soluble film, placing the printed water soluble film on water to at least partially dissolve the water soluble film, liquefying the solvent based ink image floating on the water with a solvent activator, and submerging the article in the water against the liquefying solvent based ink image to transfer the liquefied solvent based ink image to the surface of the three dimensional article. Conventionally, the image is printed on the water soluble polymer film using match color printing, which is also used for printing fabric and wallpaper. With match color printing, each color shade must be applied separately. Match color printing does not accurately reproduce photographic images. In contrast, this invention allows dip transfer printing of high definition images by providing a digital image file and printing an image from the digital image file using four color process printing. The digital image is printed onto a water soluble polymer film with solvent based ink to form a printed water soluble film using four color process printing. The resulting printed image retains the high definition look of the digital image and transfers well to the article using dip transfer printing.

This invention is particularly suitable for decorating articles with camouflage patterns and other complex images, but is capable of decorating articles with any pattern.

For example, a digital image file including a digital image can be formed using digitized imagery or artwork. The digitized image or artwork can depict a plurality of digital image elements. These digital image elements are arranged using a computer to form an image suitable for printing a seamless repeating pattern. A camouflage pattern is created by taking one or more digitized images or digital photographs of vegetation or other suitable natural scenery, identifying and selecting digital image elements in the one or more photographs and arranging the plurality of image elements with a computer to form a seamless repeating camouflage pattern. The digital image elements for example, can be leaves, branches, twigs, tree trunks, and the like.

Four color process printing accurately reproduces the digital image from the digital image file onto a water soluble film. Generally, four color process printing techniques are known. In four color process printing, four printing colors, yellow, magenta, cyan and black, are laid down separately, one after the other to faithfully produce almost any subject matter and achieve a photographic appearance to the final reproduction. With high definition printing, registration of the four images is desirably not greater than 0.006 inches and is more desirably not greater than 0.005 inches.

Suitable four color process printing techniques can be carried out using various conventional printing systems such as rotogravure, and the like. Suitable water soluble film substrates for printing include poly vinyl alcohol (PVA) film, although other water soluble films can be used. The polymer film desirably undergoes only a low degree of stretch during printing to allow for tight registration of the four color images resulting the high definition image. The particular type of film suitable for four color process printing will depend on factors such as the particular printing system used, the inks, and the desired rates of, dip transfer printing. Thus, the particular characteristics of the film may vary to some extent. In particular, the desired rate of water solubility of the film is controlled by controlling the hydrolysis rate and thickness of the film.

Suitable inks for printing on the water soluble polymer film are solvent based and should be suitable for the particular printing system used such as rotogravure. In addition, the inks should retain color density, dry quickly, adhere to the water soluble polymer film, and easily rewet with solvent.

The printed water soluble film can be used immediately for dip transfer printing, but can also be stored for shipment or later use. If stored, the printed water soluble film should be stored in a controlled humidity environment.

As explained above, the basic dip transfer printing process is known. For example, Japanese Patent No. 58041 discloses a dip transfer printing process as do U.S. Pat. Nos. 6,001,206; 6,070,636; and 5,196,400. A suitable dip transfer printing apparatus is disclosed in U.S. patent application Ser. No. 09/569,645 entitled "A Liquid Coating Applicator and Printing System With Ink Activator Sprayer" filed on Jul. 25, 2000. The disclosure of this U.S. patent application is incorporated herein by reference in its entirety.

Generally, a dip transfer printing system includes a water tank and an activator sprayer. The printed water soluble polymer film is placed on the surface of the water in the dip transfer tank such that the unprinted side of the water soluble film contacts the water and the solvent based ink image faces away from the water. The water in the dip transfer tank is preferably warmer than ambient temperature and softens and at least partially dissolves the water soluble film. The activator sprayer applies a solvent activator to the solvent based ink image floating on the water and liquefies the ink image. Suitable solvents vary depending on the particular inks used and include organic solvents such as xylene and other suitable solvents which are well known.

Meanwhile, the article for decoration is prepared for dip transfer printing. Some articles can be primed with primer paint so that the solvent based ink image transcribes to the article. Such primer is applied by any conventional means. The method of this invention is suitable for all types of three-dimensional articles which can be briefly wetted with water without damaging the article. The term three-dimensional article means objects which have substantial depth and are not thin, flat materials such as paper or film or other sheet-like materials.

The prepared article is then submerged in the water in the dipping tank against the liquefied solvent based ink image to transfer the liquefied solvent based ink image to the surface of the article. Hydrostatic pressure of the water presses the liquefied solvent based ink image against the outer surface of the article thereby permitting the decoration to transfer to the article. The decorated article is then removed from the dipping tank and washed with warm water to remove any residual water soluble polymer film. The printed article is allowed to dry and then, optionally, can be coated with a finish such as varnish or lacquer. The resulting article is decorated with a high definition image of photographic quality.

It should be understood that the foregoing relates to particular embodiments of the present invention and that numerous changes may be made therein without departing from the scope of the invention as defined by the following claims.

We claim:

1. Method for high definition printing on an article comprising the steps of:

providing a digital image file;

four color process printing an image with registration of not greater than 0.006 inch from the digital image file onto a water soluble polymer film with solvent based ink to form a printed water soluble film;

placing the printed water soluble polymer film on water to at least partially dissolve the water soluble film;

liquefying the solvent based ink image floating on the water with a solvent activator; and submerging the article in the water against the liquefied solvent based ink image to transfer the liquefied solvent based ink image to a surface of the article.

2. Method as in claim 1 wherein the image in the digital image file is suitable for printing a seamless repeating pattern.

3. Method as in claim 2 wherein the image in the digital image file is a camouflage pattern.

4. Method as in claim 1 wherein the step of providing a digital image file includes providing a digitized image or digital photograph depicting a plurality of digital image elements and arranging the plurality of digital image elements with a computer to form the image suitable for printing a seamless repeating pattern.

5. Method as in claim 4 wherein the image in the digital image file is a camouflage pattern.

6. Method as in claim 5 wherein the digitized image or digital photograph depicts vegetation and the digital image elements are components of vegetation.

7. Method as in claim 1 wherein the step of four color process printing comprises rotogravure printing.

8. Method as in claim 1 wherein the printed water soluble polymer film is placed on water such that the water soluble film contacts the water and the solvent based ink image faces away from the water.

9. Method as in claim 1 further comprising priming the article by applying a layer of primer paint to the article.

10. Method as in claim 1 further comprising rinsing the article after transferring the liquefied solvent based ink image to a surface of the article to remove residual water soluble polymer film.

11. Method as in claim 1 further comprising the step of applying a finish coating to the article after transferring the liquefied solvent based ink image to a surface of the article.

12. Method as in claim 1 wherein the water soluble polymer film is a poly vinyl alcohol film.

13. Method as in claim 1 wherein the four color process printing is performed with registration of not greater than 0.005 inch.

* * * * *